US011437758B1

(12) United States Patent
Reedy et al.

(10) Patent No.: US 11,437,758 B1
(45) Date of Patent: Sep. 6, 2022

(54) ELECTRICAL CONNECTOR ASSEMBLY

(71) Applicant: Aptiv Technologies Limited, St. Michael (BB)

(72) Inventors: Patrick Joseph Reedy, Youngstown, OH (US); Michael L. Mellot, Youngstown, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/222,030

(22) Filed: Apr. 5, 2021

(51) Int. Cl.
*H01R 13/62* (2006.01)
*H01R 13/629* (2006.01)

(52) U.S. Cl.
CPC . *H01R 13/62944* (2013.01); *H01R 13/62955* (2013.01)

(58) Field of Classification Search
None
See application file for complete search history.

(56) References Cited

U.S. PATENT DOCUMENTS

2016/0285200 A1* 9/2016 Eow ..... H01R 13/62955

FOREIGN PATENT DOCUMENTS

WO 2015113972 A1 8/2015

* cited by examiner

*Primary Examiner* — Ross N Gushi
(74) *Attorney, Agent, or Firm* — Billion & Armitage

(57) ABSTRACT

A connector assembly is presented herein. The connector assembly includes a first connector that has a fixed gear rack and a pinion gear engaged with the fixed gear rack and rotatable around a trunnion that is disposed in a first slot. The pinion gear and fixed gear rack cooperate to translate the trunnion along the slot as the pinion gear rotates. The first connector also includes a lever connected to the pinion gear configured to rotate the pinion gear and an actuator arm connected to the pinion gear defining a post protruding from the actuator arm. The connector assembly also contains a second connector that is configured to mate with the first connector. The second connector defines a second slot and a passage sized, shaped, and arranged to receive the post into the second slot.

18 Claims, 9 Drawing Sheets

ELECTRICAL CONNECTOR ASSEMBLY

This patent application is directed to a connector assembly with a mating assist mechanism, particularly a connector assembly having a fixed gear rack and a pinion gear configured to translate along the fixed gear rack.

BACKGROUND

Mating assist mechanisms such as levers or gear driven cams that have been used in prior electrical connector assembly designs as shown in FIGS. 1A and 1B are typically mounted to a shaft that is fixed within one connector of the electrical connector assembly. In these electrical connector assembly designs, all of the mating force is generated at the interface between the mechanical assist mechanism and the mating connector.

SUMMARY

According to one or more aspects of the present disclosure, a connector assembly includes a first connector that has a fixed gear rack and a pinion gear engaged with the fixed gear rack and rotatable around a trunnion that is disposed in a first slot. The pinion gear and fixed gear rack cooperate to translate the trunnion along the slot as the pinion gear rotates. The first connector also contains a lever connected to the pinion gear configured to rotate the pinion gear and an actuator arm connected to the pinion gear defining a post protruding from the actuator arm. The connector assembly further includes a second connector configured to mate with the first connector and defining a second slot and a passage that is sized, shaped, and arranged to receive the post into the second slot.

In one or more embodiments of the connector assembly according to the previous paragraph, the lever is movable from an initial position to a final position. The post is positioned to enter the passage and be disposed in the one end of the second slot when the lever is in the final position. The post translates from one end of the second slot toward an opposite end of the second slot and the trunnion translates from one end of the first slot to an opposite end of the first slot as the lever is moved from the initial position to the final position.

In one or more embodiments of the connector assembly according to any one of the previous paragraphs, the fixed gear rack and the first slot are linear. Alternatively, the fixed gear rack and the first slot are curved.

In one or more embodiments of the connector assembly according to any one of the previous paragraphs, the fixed gear rack and the first slot are parallel to one another.

In one or more embodiments of the connector assembly according to any one of the previous paragraphs, the post has a cylindrical shape.

In one or more embodiments of the connector assembly according to any one of the previous paragraphs, the post defines a compound curved shape comprising two different radii.

In one or more embodiments of the connector assembly according to any one of the previous paragraphs, the first slot first connector is oriented parallel to the second slot in the second connector.

In one or more embodiments of the connector assembly according to any one of the previous paragraphs, the fixed gear rack and the first slot are linear. Alternatively, the fixed gear rack and the first slot are curved.

In one or more embodiments of the connector assembly according to any one of the previous paragraphs, the first slot in the first connector is oriented perpendicularly to the second slot in the second connector.

According to one or more aspects of the present disclosure, a connector assembly includes a first connector and a second connector configured to mate with the first connector along a mating axis. The first connector has a fixed gear rack, a pinion gear engaged with the fixed gear rack and configured to translate along the fixed gear rack, a first actuator connected to the pinion gear configured to rotate the pinion gear, and a second actuator connected to the pinion gear configured to rotate with the pinion gear. Rotation of the pinion gear translates the pinion gear along the fixed gear rack. The second actuator engages the second connector and moves the first connector relative to the second connector along the mating axis as the pinion gear rotates.

In one or more embodiments of the connector assembly according to the previous paragraph, the pinion gear has a trunnion disposed within a first slot in the first connector having a major axis that is parallel with the translation axis.

In one or more embodiments of the connector assembly according to any one of the previous paragraphs, the second actuator includes an arm projecting from the pinion gear having a post protruding from a free end of the arm. The post is disposed within a second slot defined by the second connector.

In one or more embodiments of the connector assembly according to any one of the previous paragraphs, the post translates from one end of the second slot toward an opposite end of the second slot as the trunnion translates from one end of the first slot to an opposite end of the first slot.

In one or more embodiments of the connector assembly according to any one of the previous paragraphs, the second slot is aligned orthogonally to the mating axis and wherein the second connector defines a passage shaped, sized, and arranged to allow the post to enter the second slot as the first connector is mated with the second connector.

In one or more embodiments of the connector assembly according to any one of the previous paragraphs, the first actuator includes a lever projecting from the pinion gear that is movable from an initial position to a final position. The post is positioned to enter the passage and be disposed in the one end of the second slot to a final position when the lever is in the final position and the post translates from the one end of the second slot toward the opposite end of the second slot and the trunnion translates from the one end of the first slot to the opposite end of the first slot as the lever moves from the initial position to the final position, thereby moving the first connector relative to the second connector along the mating axis.

In one or more embodiments of the connector assembly according to any one of the previous paragraphs, the first slot is oriented perpendicularly to the second slot and the post moves in a direction orthogonal to the movement of the trunnion as the post translates from the one end of the second slot toward the opposite end of the second slot and trunnion translates from the one end of the first slot to the opposite end of the first slot. Alternatively, the first slot is oriented parallel to the second slot and the post moves in a direction parallel and opposite to the movement of the trunnion as the post translates from the one end of the second slot toward the opposite end of the second slot and trunnion translates from the one end of the first slot to the opposite end of the first slot.

In one or more embodiments of the connector assembly according to any one of the previous paragraphs, the first actuator includes a lever projecting from the pinion gear that is movable from an initial position to a final position. The post is positioned to enter the passage and be disposed in the one end of the second slot to a final position when the lever is in the final position and the post translates from the one end of the second slot toward the opposite end of the second slot and trunnion translates from the one end of the first slot to the opposite end of the first slot as the lever moves from the initial position to the final position, thereby moving the first connector relative to the second connector along the mating axis.

According to one or more aspects of the present disclosure, a connector assembly includes a first connector, a second connector configured to mate with the first connector along a mating axis, and a means for drawing the first and second connectors together along a mating axis.

In one or more embodiments of the connector assembly according to the previous paragraph, the connector assembly further includes a means for moving a portion of the drawing means from an initial position in which the first and second connectors are unmated to a final position in which the first and second connectors are fully mated.

DESCRIPTION OF THE DRAWINGS

The present invention will now be described, by way of example with reference to the accompanying drawings, in which.

Figure 1A:
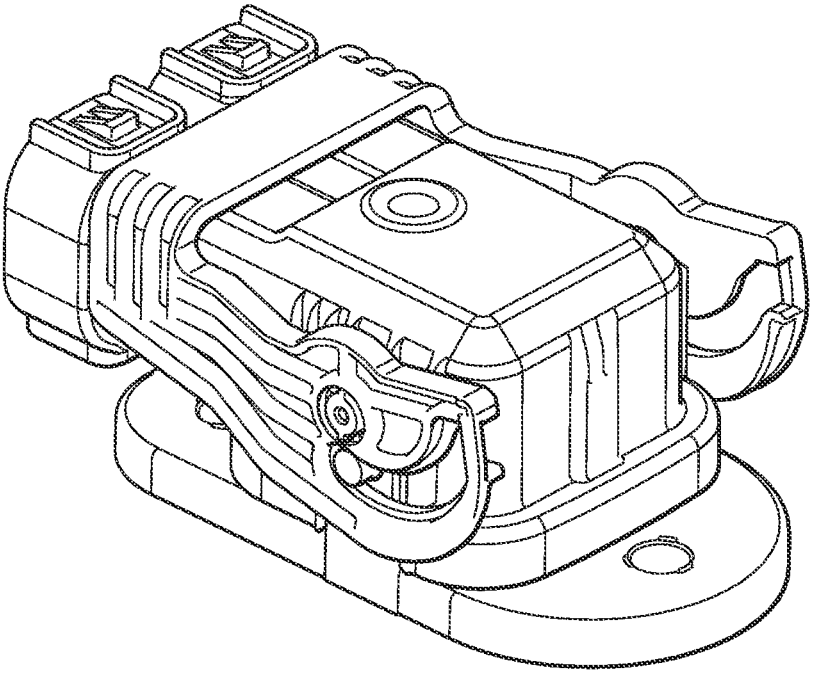
PRIOR ART FIG. 1A
FIGS. 1A and 1B are perspective views of a connector assembly with a mating assist mechanism according to the prior art.

In the drawings, different versions of the elements of the various embodiments share the last two digits of the reference numbers.

DETAILED DESCRIPTION

Figure 1B:
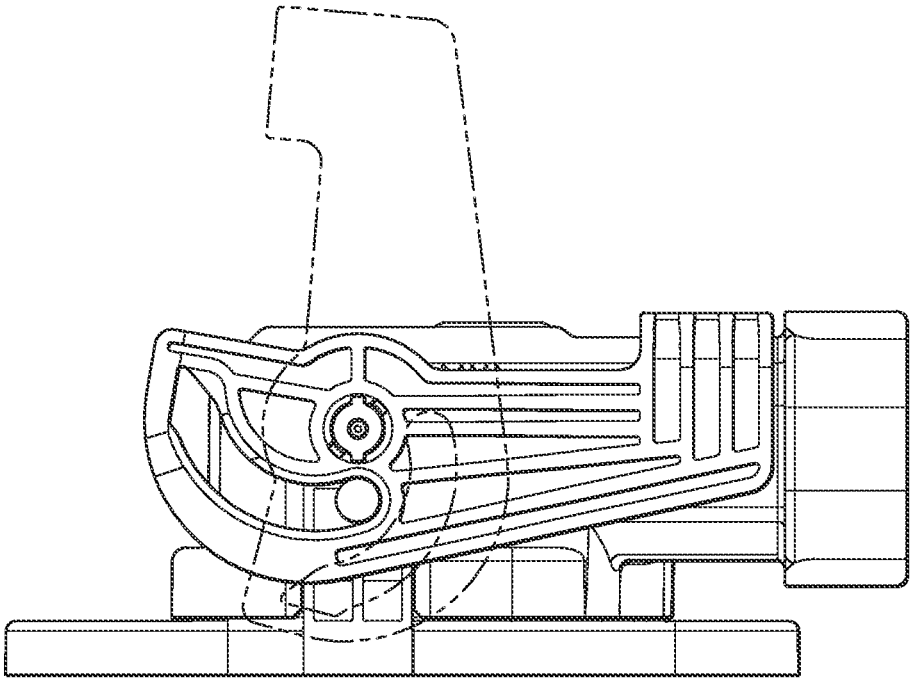
PRIOR ART FIG. 1B

A connector assembly with a mating assist mechanism is described herein. The connector assembly includes a gear driven mechanical assist mechanism that utilizes a gear rack and pinion gear with a floating or translating pivot or trunnion that is configured to generate a mating force between the mechanical assist mechanism and the individual connectors of the connector assembly. The translational movement between the gear rack and the pinion gear together with the translation movement of the connectors caused by the mechanical assist mechanism combine to produce greater total relative motion between the connectors in a smaller package than a conventional mating assist mechanism with a fixed pivot as illustrated in FIGS. 1A and 1B.

Figure 2:
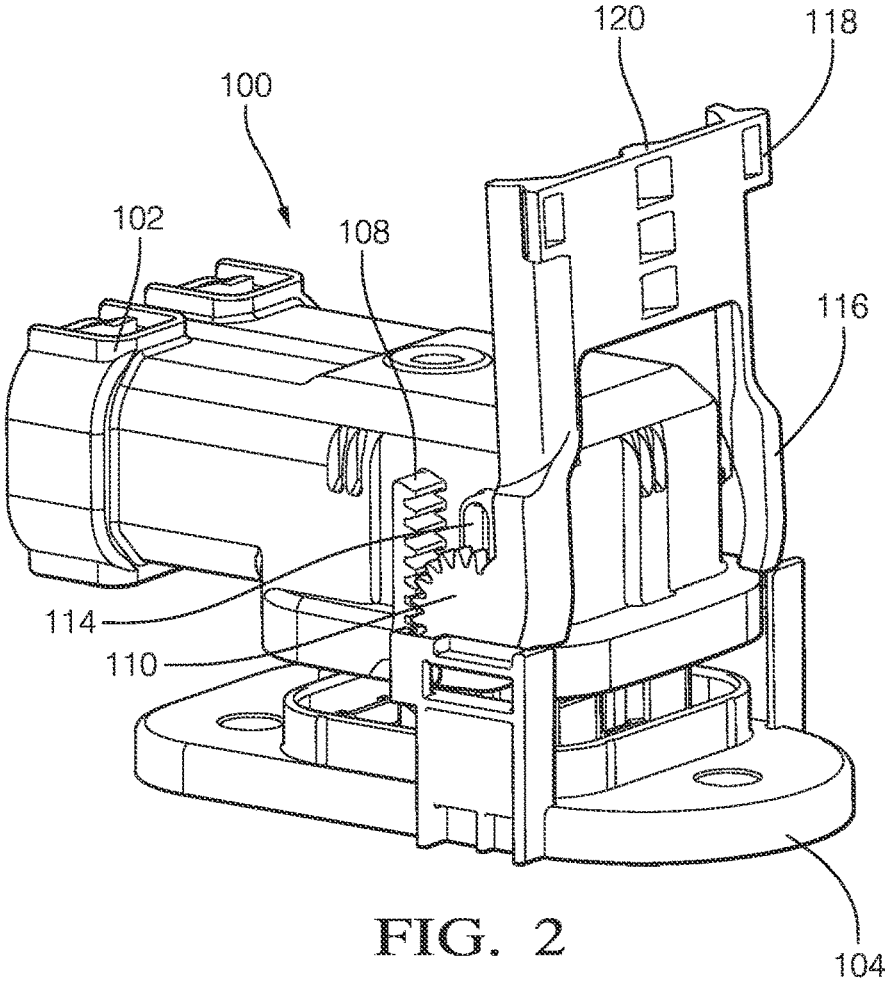
FIG. 2 is a perspective view of a connector assembly with a mating assist mechanism in an unmated condition according to some embodiments.
Figure 3:
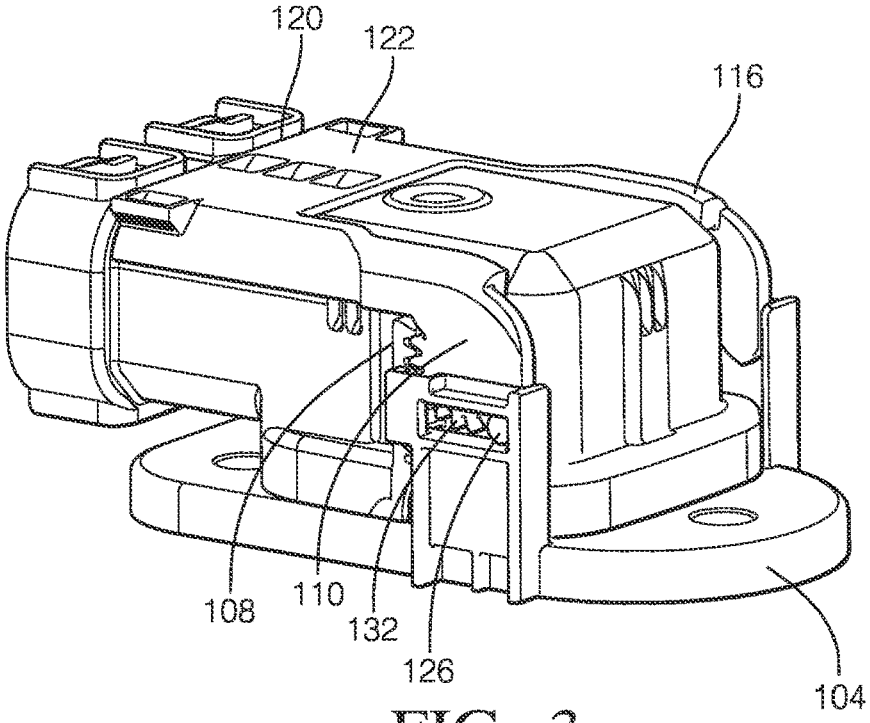
FIG. 3 is a perspective view of the connector assembly of FIG. 2 in a mated condition according to some embodiments.
Figure 4:
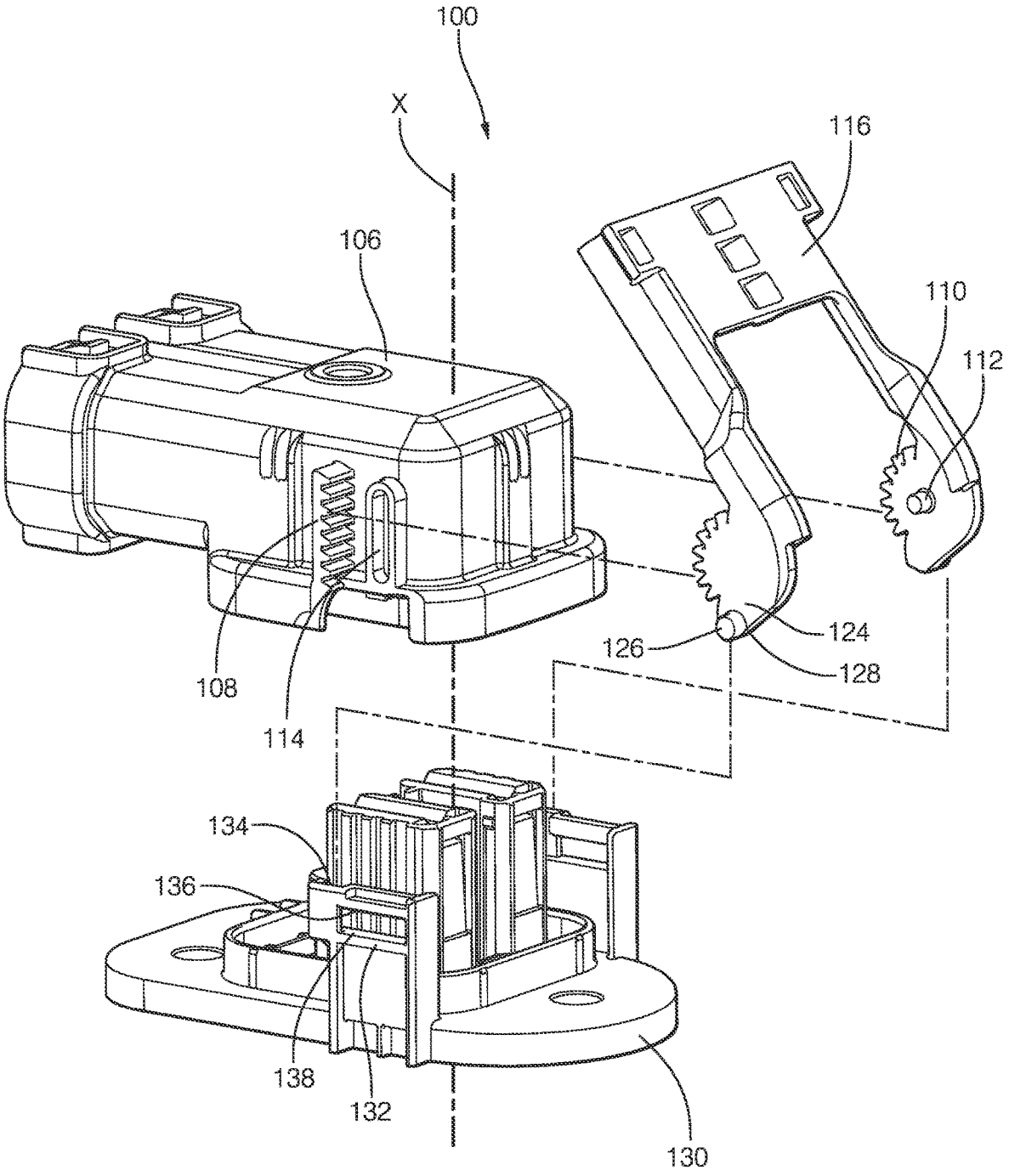
FIG. 4 is an exploded view of the connector assembly of FIG. 2 according to some embodiments.

FIGS. 2 through 7B illustrate examples of an electrical connector assembly 100 with a first mating assist mechanism design. The example connector assembly 100 in FIGS. 2-4 are of a right-angled connector assembly while example connector assembly 100 in FIGS. 5A-7B is of a straight connector assembly. The mechanical assign mechanism of both examples is the same. The connector assembly 100 includes a first connector 102, in this example an electrical connector used to terminate an electrical wiring harness, and a second connector 104, which in this example is a header that may be mounted to a panel or other surface. Although not shown, the first and second connectors 102, 104 include electrical terminals, such as plugs and receptacles, to make electrical interconnections between the first and second connectors 102, 104.

The first connector 102 includes a first connector body 106 that is formed of an insulative polymeric material and contains the plurality of electrical terminals within cavities formed in the first connector body (not shown). The first connector body 106 defines a linear fixed gear rack 108 that is integrally formed in the first connector body 106. In the example illustrated in FIGS. 2-7B, the fixed gear rack 108 is arranged such that is it generally parallel to a mating axis X of the connector assembly. The first connector 102 also includes a pinion gear 110 that is engaged with the fixed gear rack 108. The pinion gear 110 is configured to rotatable around a cylindrical trunnion 112 that is disposed in a first slot 114 defined in the first connector body 106. In the example shown in FIGS. 2-7B, the first slot 114 is arranged such that is it also generally parallel to the mating axis X of the connector assembly 100 and the fixed gear rack 108. The fixed gear rack 108 and the pinion gear 110 cooperate to translate the trunnion 112 along the first slot 114 as the pinion gear 110 rotates. A lever 116 is connected to the pinion gear 110 and is configured to rotate the pinion gear 110 as the lever 116 is moved from an initial position 118 in which a free end 120 of the lever 116 is located away from the first connector body 106 to a final position 122 in which the free end 120 of the lever 116 is nearer or in contact with the first connector body 106. The first connector 102 also includes an actuator arm 124 that is connected to the pinion gear 110 on a side of the pinion gear 110 generally opposite the lever 116. The actuator arm 124 defines a cylindrical post 126 that protrudes from a side of the actuator arm 124 near a free end 128 of the actuator arm 124.

The second connector 104 includes a second connector body 130 also formed of an insulative polymeric material defining cavities that contains a corresponding plurality of mating electrical terminals (not shown). The second connector 104 is configured to mate with the first connector 102, thereby connecting the electrical terminals in the first connector 102 to the electrical terminals in the second connector 104. The second connector body 130 defines a second slot 132 and a passage 134 extending from the second slot 132 that is sized, shaped, and arranged to receive the post 126 on the actuator arm 124 of the first connector 102 into the second slot 132. Examples of insulative materials may be used to form the first and second connector bodies are polybutylene terephthalate (PBT), acrylonitrile butadiene styrene (ABS) or polyamide (NYLON) polymers, These polymers may or may not be glass filled.

Figure 5A:
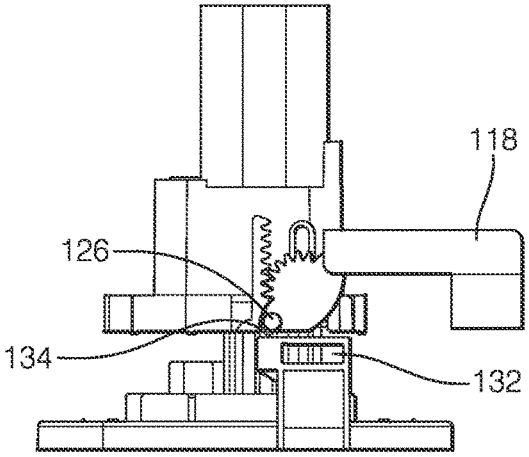
FIGS. 5A and 5B are side and perspective views of a connector assembly in the unmated condition according to some embodiments.
Figure 5B:
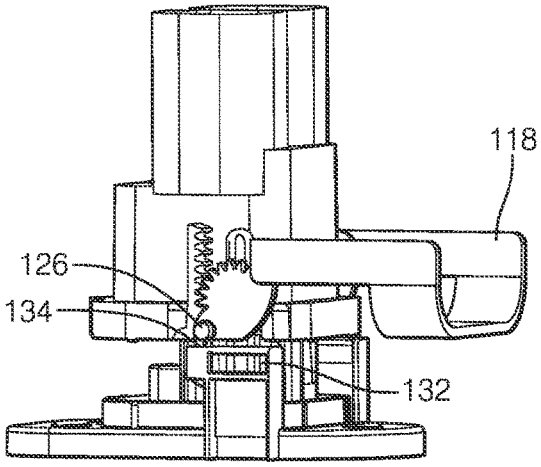
Figure 6A:
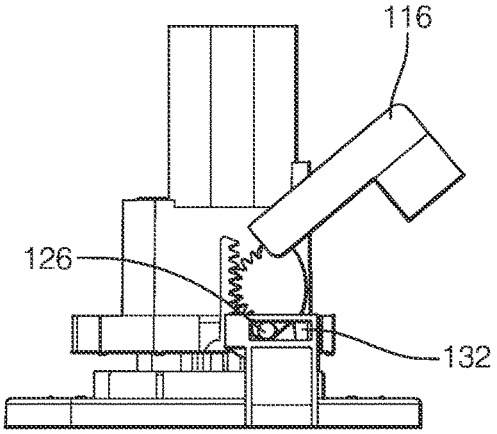
FIGS. 6A and 6B are side and perspective views of the connector assembly of FIG. 5A in an intermediate stage between the unmated condition and the mated condition according to some embodiments.
Figure 6B:
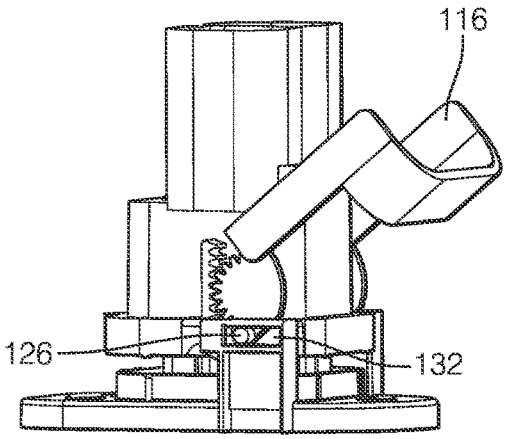
Figure 7A:
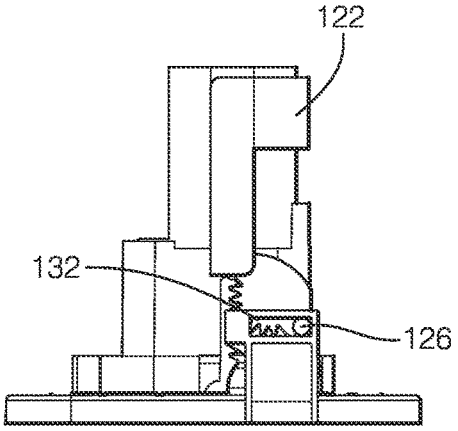
FIGS. 7A and 7B are side and perspective views of the connector assembly of FIG. 5A in the mated condition according to some embodiments.
Figure 7B:
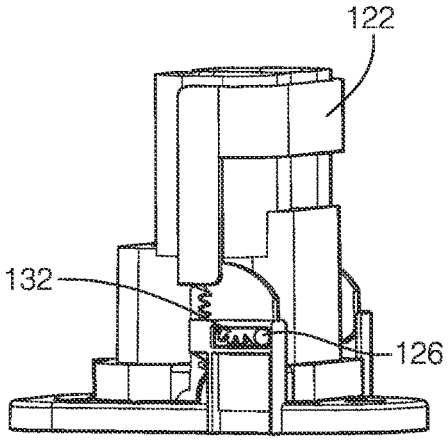
Figure 8:
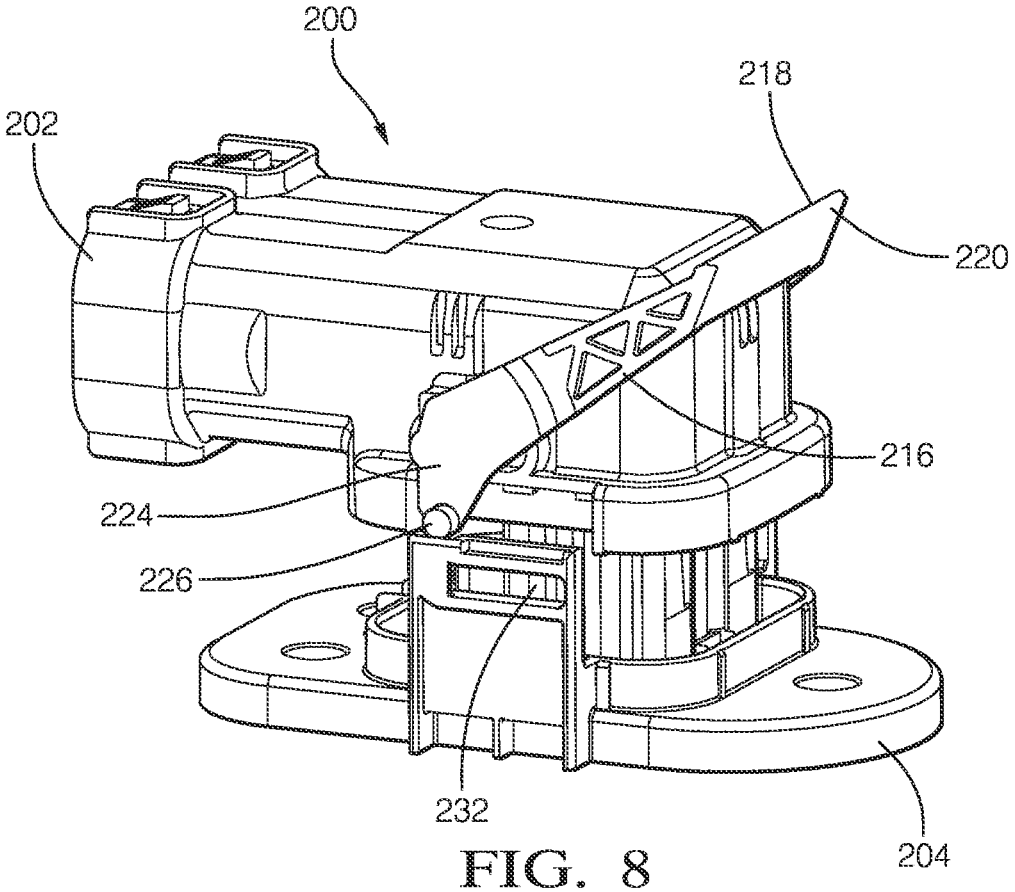
FIG. 8 is a perspective view of another connector assembly with a mating assist mechanism in an unmated condition according to some embodiments.
Figure 9:
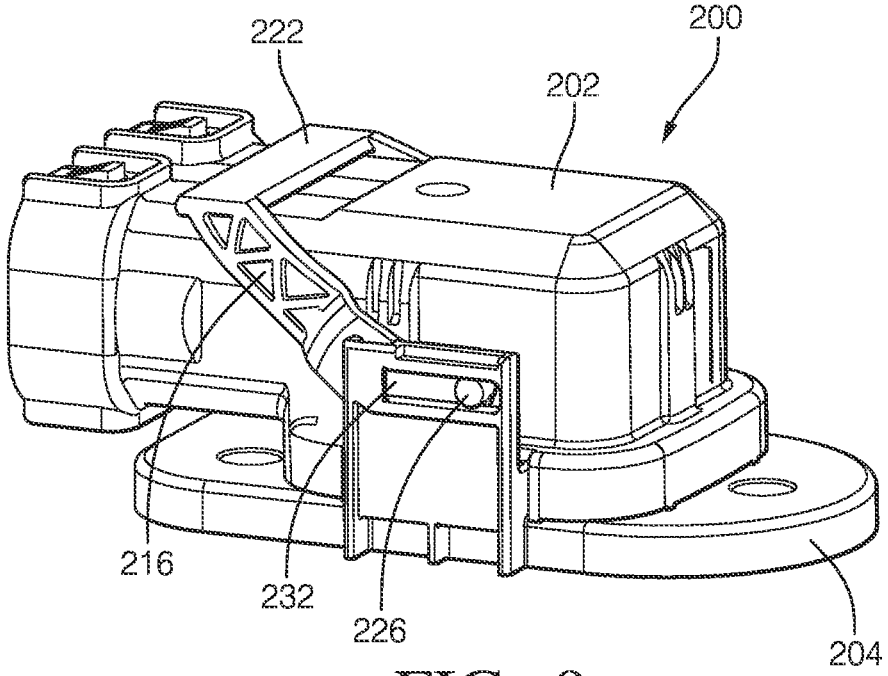
FIG. 9 is a perspective view of the connector assembly of FIG. 8 in a mated condition according to some embodiments.
Figure 10:
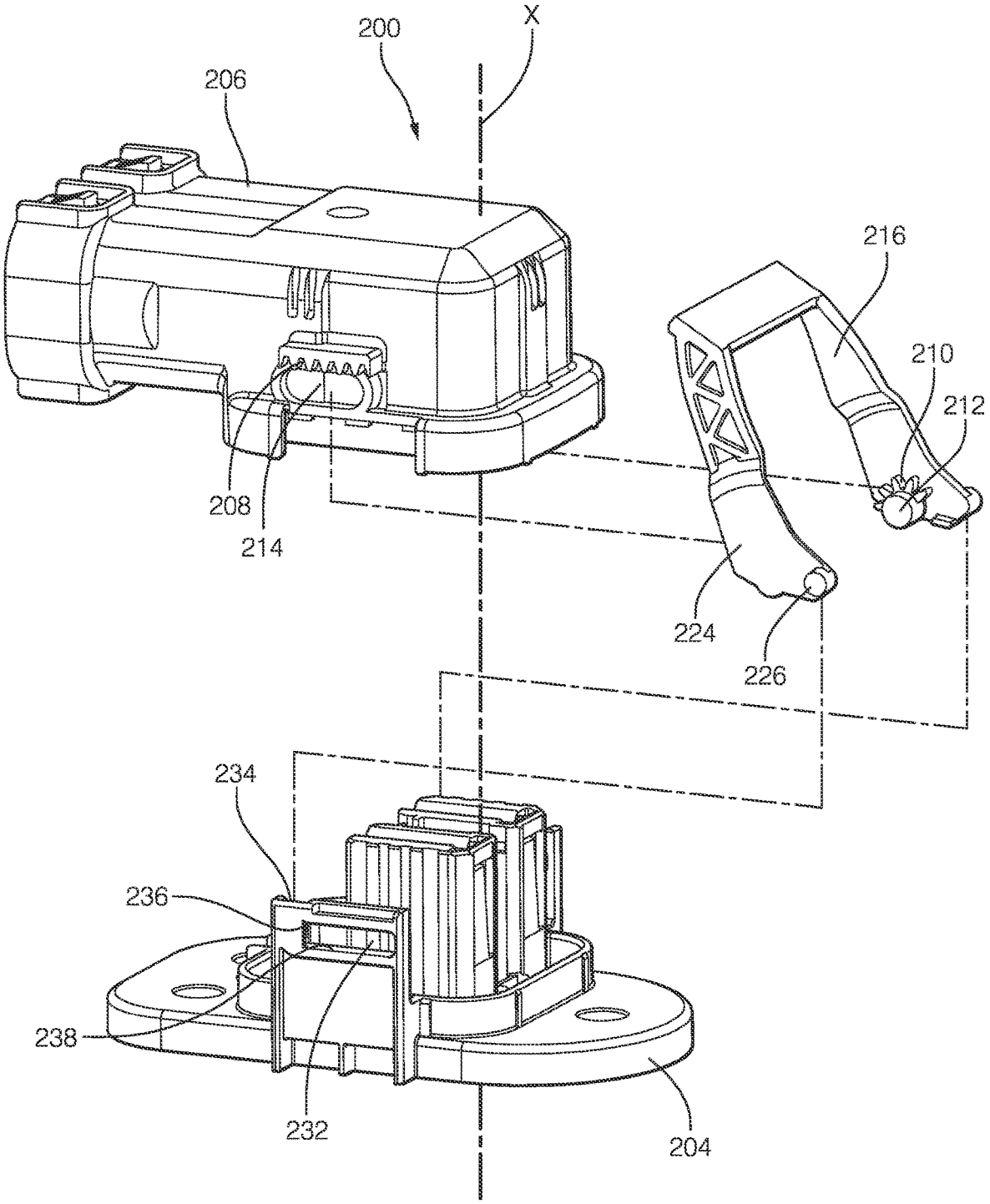
FIG. 10 is an exploded view of the connector assembly of FIG. 8 according to some embodiments.

The sequence of mating the first connector 102 to the second connector 104 is illustrated in FIGS. 5A-7B. As shown in FIGS. 5A and 5B, the post 126 is aligned with the passage 134 while the lever 116 is in the initial position 118 prior to mating the first connector 102 with the second connector 104. As seen in FIGS. 5A and 5B, the trunnion 112 is situated at or near the bottom end of the first slot 114. In FIGS. 6A and 6B, the post 126 has entered the passage 134 and is now disposed in one end of the second slot 132 and the lever 116 is moved from the initial position 118 toward the final position 122. As the lever 116 moves, the engagement of the pinion gear 110 with the fixed gear rack 108 translates the trunnion 112 upwardly through the first slot 114 and applies a mating force to the load bearing surface on the upper inner wall 136 of the second slot 132, thereby drawing the first connector 102 and the second connector 104 together as the post 126 attached to the actuator arm 124 is also translated in the same direction and exerts a mating force on the second slot of the second connector. In addition, post pivots around the trunnion as the lever moves from the initial position to the final position, moving the post along the second slot from the one end toward the other end while contacting the load bearing surface on the upper inner wall 136 of the second slot 132, thereby generating an additional mating force to further draw the first connector 102 and the second connector 104 together. FIGS. 7A and 7B show the connector assembly 100 in the fully mated condition with the lever 116 in the final position 122. Here, the trunnion 112 is disposed at the top end of the first slot 114 and the post 126 is disposed at the other end of the second slot 132. The combined action of the translation of the trunnion 112 in the first slot 114 and the post 126 in the second slot 132 provides a greater movement distance of the first connector 102 relative to the second connector 104 than would be provided by the fixed gear rack 108 and pinion gear 110 or the actuator arm 124 alone. This also provides the benefit of a compact lever 116 which is beneficial for reducing the required packaging space needed by the connector assembly 100.

The first and second connectors 102, 104 may be unmated from one another simply by moving the lever 116 from the final position 122 back to the initial position 118. In this case, as the lever 116 moves, the engagement of the pinion gear 110 with the fixed gear rack 108 translates the trunnion 112 downwardly through the first slot 114 and applies a unmating force to the load bearing surface on the lower inner wall 138 of the second slot 132, thereby pushing the first connector 102 and the second connector 104 apart as the post 126 attached to the actuator arm 124 is also translated in the same direction and exerts a unmating force on the lower inner wall 138 of the second slot 132 of the second connector 104.

FIGS. 8 through 13B illustrate other examples of the connector assembly 200 with a second mating assist mechanism design. In this example, the fixed gear rack 208 and the first slot 214 are arranged perpendicularly to the mating axis X rather than parallel to the mating axis X. This arrangement also allows the free end 220 of the lever 216 to be located closer to the first connector body 206 when the lever 216 is in the initial position 218, further reducing the packaging space required for this connector assembly 200.

Figure 11A:
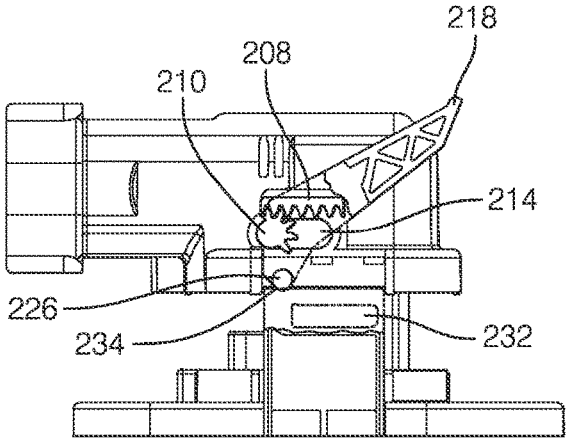
FIG. 11A is a partial cut-away side and FIG. 11B is a perspective view of the connector assembly of FIG. 8 in the unmated condition according to some embodiments.
Figure 11B:
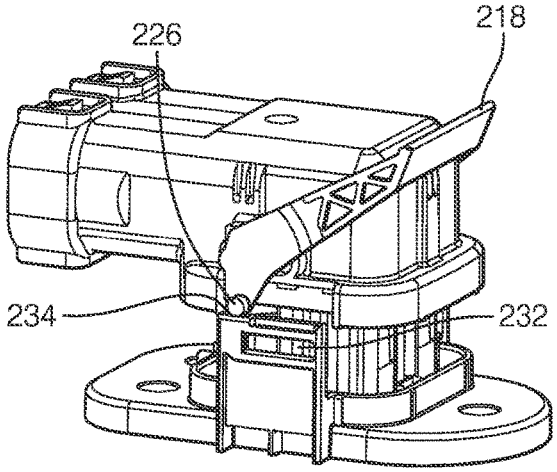
Figure 12A:
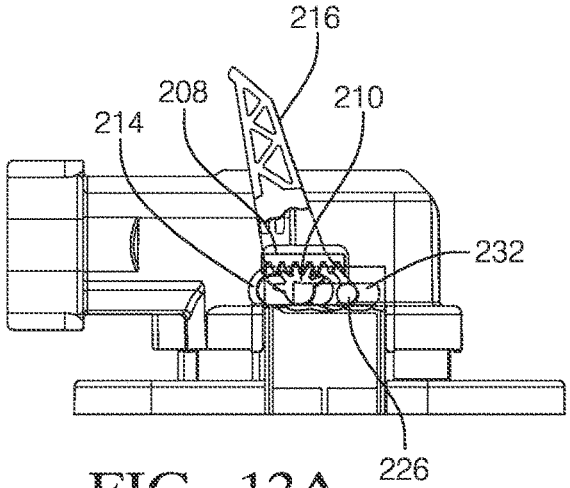
FIG. 12A is a partial cut-away side and FIG. 12B is a perspective view of the connector assembly of FIG. 8 in an intermediate stage between the unmated condition and the mated condition according to some embodiments.
Figure 12B:
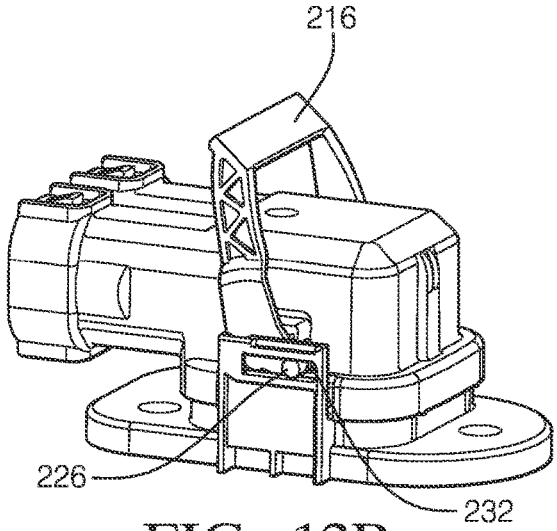
Figure 13A:
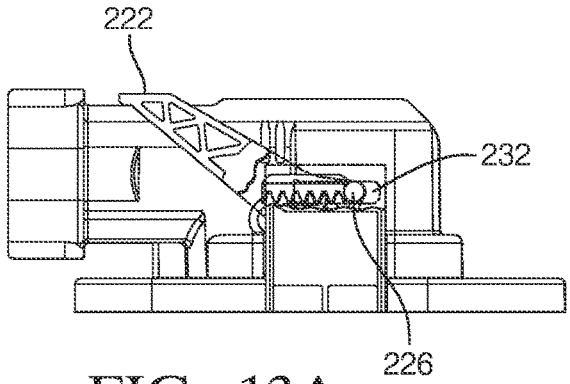
FIG. 13A is a partial cut-away side and FIG. 13B is a perspective view of the connector assembly of FIG. 8 in the mated condition according to some embodiments.
Figure 13B:
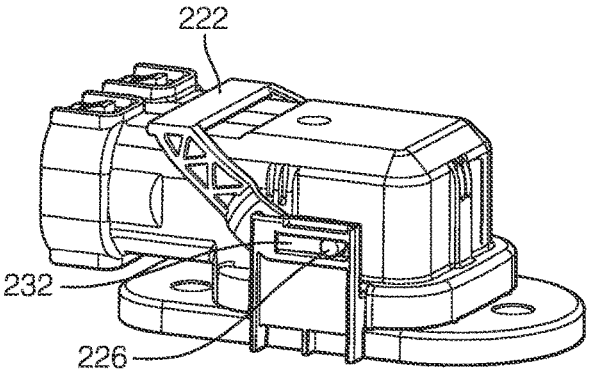

The sequence of mating the first connector 202 to the second connector 204 is illustrated in FIGS. 11A-13B. As shown in FIGS. 11A and 11B, the post 226 is aligned with the passage 234 while the lever 216 is in the initial position 218 prior to mating the first connector 202 with the second connector 204. As seen in FIGS. 11A and 11B, the trunnion 212 is situated in the first slot 214 above the post 226. In FIGS. 12A and 12B, the post 226 has been inserted into the passage 234 and is now disposed in the second slot 232 as the lever 216 is moved from the initial position 218 toward the final position 222. As the lever 216 moves, the engagement of the pinion gear 210 with the fixed gear rack 208 translates the trunnion 212 thru the first slot 214 in the same direction as the post 226 moves through the second slot 232 and applies a mating force to the load bearing surface on the upper inner wall 236 of the second slot 232, thereby drawing the first connector 202 and the second connector 204 together as the post 226 attached to the actuator arm 224 is also translated in the same direction and exerts a mating force on the upper inner wall 236 of the second slot 232 of the second connector 204. FIGS. 13A and 13B show the connector assembly 200 in the fully mated condition with the lever 216 in the final position 222, the trunnion 212 is disposed at one end of the first slot 214 and the post 226 is disposed at the same end of the second slot 232. The combined action of the translation of the trunnion 212 in the first slot 214 and the post 226 in the second slot 232 provides a greater movement distance of the first connector 202 relative to the second connector 204 than would be provided by the fixed gear rack 208 and pinion gear 210 or actuator arm 224 alone.

The first and second connectors 202, 204 may be unmated from one another simply by moving the lever 216 from the final position 222 back to the initial position 218. In this case, as the lever 216 moves, the engagement of the pinion gear 210 with the fixed gear rack 208 translates the trunnion 212 through the first slot 214 and applies a unmating force to the load bearing surface on the lower inner wall 238 of the second slot 232, thereby pushing the first connector 202 and the second connector 204 apart as the post 226 attached to the actuator arm 224 is also translated in the same direction and exerts a unmating force on the lower inner wall 238 of the second slot 232 of the second connector 204.

Figure 14A:
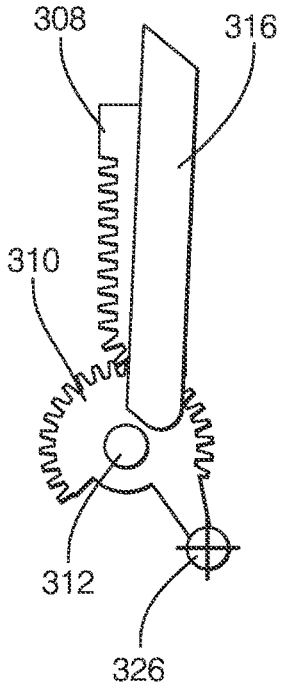
FIGS. 14A-14D are schematic views of a curved fixed gear rack and travel of a pinion gear according to some embodiments.
Figure 14B:
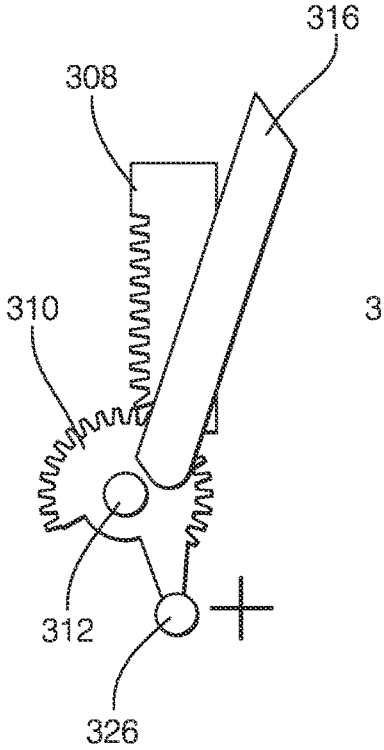
Figure 14C:
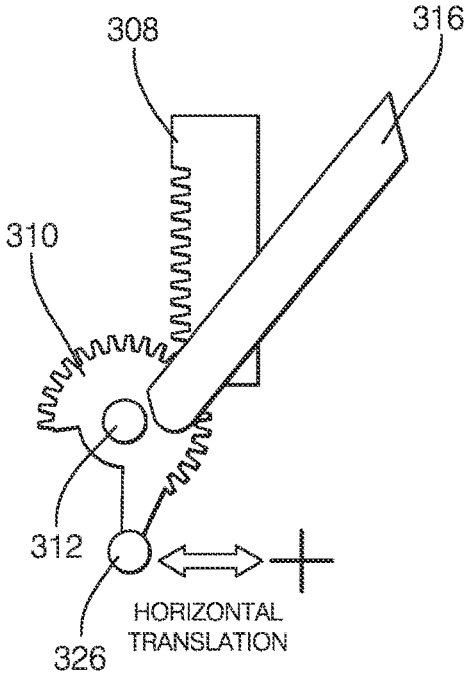
Figure 14D:
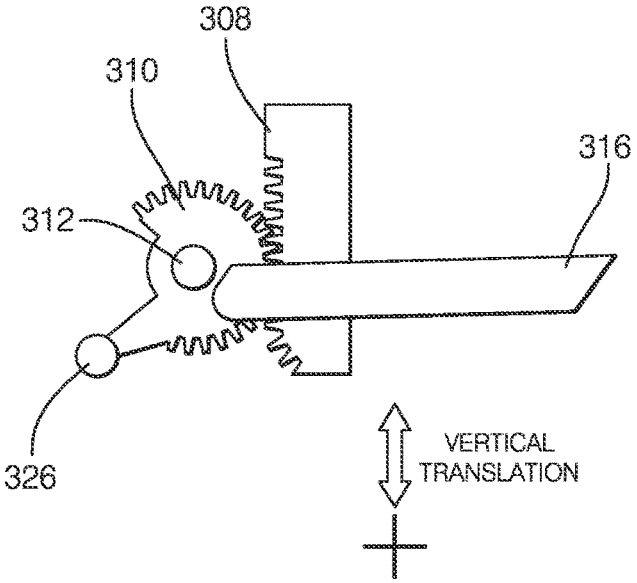
Figure 15:
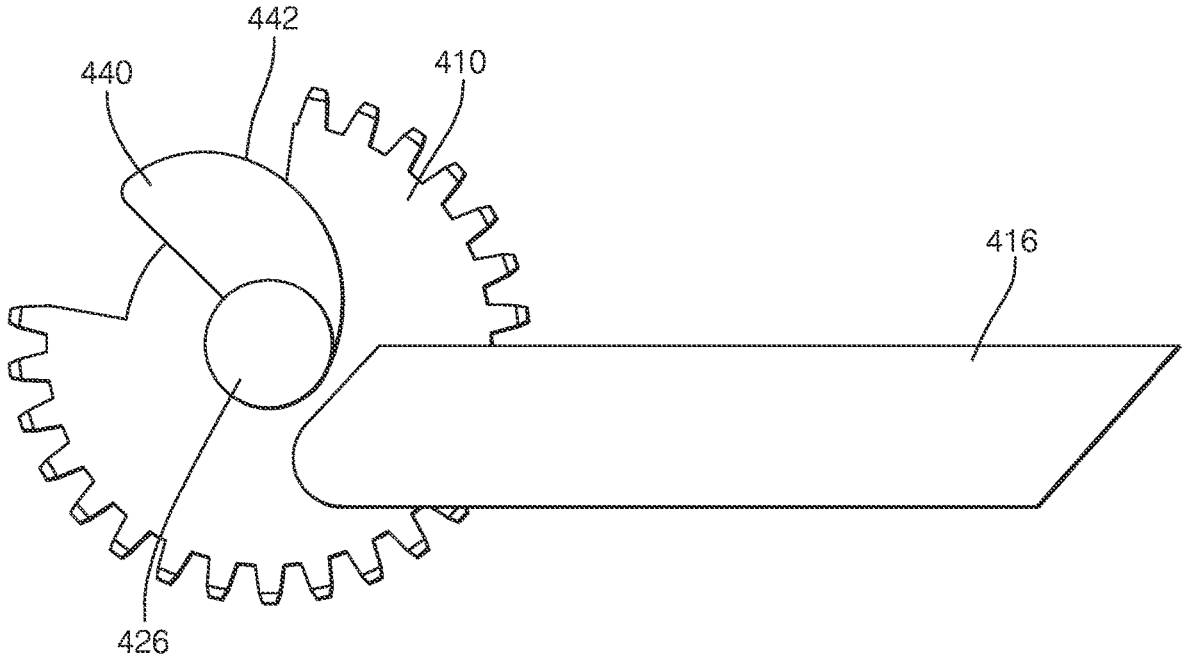
FIG. 15 is a side view of a pinion gear having a post with a cammed according to some embodiments.

In other embodiments, the fixed gear rack 308 may be curved as illustrated in FIGS. 14A-14D rather than linear as shown in FIG. 2-13B. The trunnion 312 on the pinion gear 310 travels in a curved first slot (not shown) that generally matches the curvature of the fixed gear rack 308 as the lever 316 is moved, thereby translating the post 326 horizontally as shown in FIGS. 14A-14C and then vertically as shown in FIG. 14D. In additional different embodiments, a portion 440 of the post 426 on the pinion gear 410 that is attached to the lever 416 may have a cam shape with a compound curved surface 442 having at least two different radii as shown in FIG. 15. This cam shaped portion 440 is in contact with the load bearing surface of the second connector (not shown), which may or may not be within a slot. In yet other alternative embodiment that is not illustrated herein, the pinion gear may be actuated by another rack and pinion configuration rather than the lever arm. Such an arrangement is shown in U.S. Pat. No. 10,186,807, the entire disclosure of which is hereby incorporated by reference.

While the illustrated examples are directed to an electrical connector assembly 100, 200, other embodiments may be envisioned that are adapted for use with other types of connector assemblies, such as those used for fiber optic cables, pneumatic tubes, hydraulic tubes, or a hybrid connector assembly including two or more of the items listed above. Further, while the illustrated examples of the connector assemblies 100, 200 show that the first and second slots 114, 132, 214, 232 and pinion gear racks 108, 208 are generally oriented parallel or perpendicularly to the mating axis X, other embodiments of the connector assembly may be envisioned in which the first and second slots and pinion gear racks are angled so that they are nonparallel and non-perpendicular to the mating axis.

While the invention has been described with reference to an exemplary embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. A connector assembly, comprising:

a first connector that includes a fixed gear rack, a pinion gear engaged with the fixed gear rack and rotatable around a trunnion that is disposed in a first slot, wherein the pinion gear and the fixed gear rack cooperate to translate the trunnion along the slot as the pinion gear rotates, a lever connected to the pinion gear configured to rotate the pinion gear, and an actuator arm connected to the pinion gear defining a post protruding from the actuator arm; and a second connector configured to mate with the first connector and defining a second slot and a passage sized, shaped, and arranged to receive the post into the second slot.

2. The connector assembly according to claim 1, wherein the lever is movable from an initial position to a final position, wherein the post is positioned to enter the passage and be disposed in one end of the second slot when the lever is in the final position and wherein the post translates from the one end of the second slot toward an opposite end of the second slot and the trunnion translates from one end of the first slot to an opposite end of the first slot as the lever is moved from the initial position to the final position.

3. The connector assembly according to claim 1, wherein the fixed gear rack and the first slot are linear.

4. The connector assembly according to claim 1, wherein the fixed gear rack and the first slot are curved.

5. The connector assembly according to claim 1, wherein the fixed gear rack and the first slot are parallel to one another.

6. The connector assembly according to claim 1, wherein the post has a cylindrical shape.

7. The connector assembly according to claim 1, wherein the post defines a compound curved shape comprising two different radii.

8. The connector assembly according to claim 1, wherein the first slot first connector is oriented parallel to the second slot in the second connector.

9. The connector assembly according to claim 1, wherein the first slot in the first connector is oriented perpendicularly to the second slot in the second connector.

10. A connector assembly, comprising:

a first connector; and a second connector connectable with the first connector in a direction of an axis along which the connectors mate, wherein the first connector includes a fixed gear rack, a pinion gear engaged with the fixed gear rack and configured to translate along the fixed gear rack, a first actuator connected to the pinion gear configured to rotate the pinion gear, and a second actuator connected to the pinion gear configured to rotate with the pinion gear, wherein rotation of the pinion gear translates the pinion gear along the fixed gear rack and wherein the second actuator engages the second connector and moves the first connector relative to the second connector on the axis along which the connectors mate as the pinion gear rotates and wherein the second actuator includes an arm projecting from the pinion gear having a post protruding from a free end of the arm.

11. The connector assembly according to claim 10, wherein the pinion gear has a trunnion disposed within a first slot in the first connector.

12. The connector assembly according to claim 11, wherein the post is disposed within a second slot defined by the second connector.

13. The connector assembly according to claim 12, wherein the post translates from one end of the second slot toward an opposite end of the second slot as the trunnion translates from one end of the first slot to an opposite end of the first slot.

14. The connector assembly according to claim 13, wherein the second slot is aligned orthogonally to the axis along which the connectors mate and wherein the second connector defines a passage shaped, sized, and arranged to allow the post to enter the second slot as the first connector is mated with the second connector.

15. The connector assembly according to claim 14, wherein the first slot is oriented parallel to the second slot and the post moves in a direction parallel and opposite to movement of the trunnion as the post translates from the one end of the second slot toward the opposite end of the second slot and trunnion translates from the one end of the first slot to the opposite end of the first slot.

16. The connector assembly according to claim 15, wherein the first actuator includes a lever projecting from the pinion gear that is movable from an initial position to a final position, wherein the post is positioned to enter the passage and be disposed in the one end of the second slot to a final position when the lever is in the final position and the post translates from the one end of the second slot toward the opposite end of the second slot and the trunnion translates from the one end of the first slot to the opposite end of the first slot as the lever moves from the initial position to the final position, thereby moving the first connector relative to the second connector on the axis along which the connectors mate.

17. The connector assembly according to claim 14, wherein the first slot is oriented perpendicularly to the second slot and the post moves in a direction orthogonal to movement of the trunnion as the post translates from the one end of the second slot toward the opposite end of the second slot and trunnion translates from the one end of the first slot to the opposite end of the first slot.

18. The connector assembly according to claim 17, wherein the first actuator includes a lever projecting from the pinion gear that is movable from an initial position to a final position, wherein the post is positioned to enter the passage and be disposed in the one end of the second slot to a final position when the lever is in the final position and the post translates from the one end of the second slot toward the opposite end of the second slot and trunnion translates from the one end of the first slot to the opposite end of the first slot as the lever moves from the initial position to the final position, thereby moving the first connector relative to the second connector on the axis along which the connectors mate.

* * * * *